US006734889B2

(12) United States Patent
Ramanujan et al.

(10) Patent No.: US 6,734,889 B2
(45) Date of Patent: May 11, 2004

(54) COLOR PRINTER COMPRISING A LINEAR GRATING SPATIAL LIGHT MODULATOR

(75) Inventors: Sujatha Ramanujan, Pittsford, NY (US); David Kessler, Rochester, NY (US); Joshua M. Cobb, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/238,105

(22) Filed: Sep. 10, 2002

(65) Prior Publication Data

US 2004/0046861 A1 Mar. 11, 2004

(51) Int. Cl.[7] ..... B41J 2/47
(52) U.S. Cl. ..... 347/239; 347/255
(58) Field of Search ..... 347/129, 130, 347/238, 239, 240, 244, 251, 252, 255, 258

(56) References Cited

U.S. PATENT DOCUMENTS

| | | | | |
|---|---|---|---|---|
| 4,728,965 A | | 3/1988 | Kessler et al. | 347/241 |
| 5,061,049 A | | 10/1991 | Hornbeck | 359/224 |
| 5,311,360 A | | 5/1994 | Bloom et al. | 359/572 |
| 5,325,137 A | | 6/1994 | Konno et al. | 353/63 |
| 5,459,610 A | | 10/1995 | Bloom et al. | 359/572 |
| 5,461,410 A | | 10/1995 | Venkateswar et al. | 347/240 |
| 5,461,411 A | | 10/1995 | Florence et al. | 347/240 |
| 5,504,514 A | | 4/1996 | Nelson | 347/130 |
| 5,521,748 A | | 5/1996 | Sarraf | 359/321 |
| 5,652,661 A | | 7/1997 | Gallipeau et al. | 358/302 |
| 5,701,185 A | | 12/1997 | Reiss et al. | 358/471 |
| 5,721,622 A | | 2/1998 | Venkateswar | 358/3.01 |
| 5,743,610 A | | 4/1998 | Yajima et al. | 353/31 |
| 5,745,156 A | | 4/1998 | Federico et al. | 347/256 |
| 5,754,305 A | | 5/1998 | DeClerck et al. | 358/302 |
| 5,805,274 A | | 9/1998 | Saita | 355/38 |
| 5,933,183 A | * | 8/1999 | Enomoto et al. | 347/241 |
| 6,084,626 A | | 7/2000 | Ramanujan et al. | 347/239 |
| 6,215,547 B1 | | 4/2001 | Ramanujan et al. | 355/67 |

* cited by examiner

*Primary Examiner*—Hai Pham
(74) *Attorney, Agent, or Firm*—Nelson Adrian Blish

(57) ABSTRACT

A printer for printing on a light sensitive media (100) includes a light source (10) and optics. Cross array components and array direction components reduce divergence of the beam from the light. The illumination optics flood illuminates a grating modulator with reduced light beams. Modulator sites on the grating modulator array, are individual addressed which imparts a phase change to the reduced light beams. An imaging lens (70) directs light from the grating modulator array onto the light sensitive media (100). The imaging lens (70) includes a first lens element which converts the light into diffracted and undiffracted light; a spatial filter (80) which discriminates between the diffracted and the undiffracted light; and a second lens element which reconstructs an image of the modulator sites.

42 Claims, 8 Drawing Sheets

COLOR PRINTER COMPRISING A LINEAR GRATING SPATIAL LIGHT MODULATOR

FIELD OF THE INVENTION

This invention relates generally to a method for spatially and temporally modulating a light beam and more specifically to imaging a modulated light onto a photosensitive media.

BACKGROUND OF THE INVENTION

Photographic images are traditionally printed on photographic paper using conventional, film based optical printers. The photographic industry, however, is converting to digital imaging. One step in the digital printing process to use images obtained from digital cameras, or scanned film exposed in traditional photographic cameras, to create digital image files that are then printed onto photographic paper.

The growth of the digital printing industry has led to multiple approaches to digital printing. One of the early methods used for digital printing was cathode ray tube (CRT) based printers such as the Centronics CRT recorder. This technology has several limitations related to the phosphor and the electron beam. The resolution of this technology is inadequate when printing a large format image, such as 8 inch by 10 inch photographic print. CRT printers also tend to be expensive, which is a severe shortcoming in a cost sensitive market. An additional limitation is that CRT printers do not provide sufficient red exposure to the media when operating at frame rates above 10,000 prints per hour.

Another commonly used approach to digital printing is the laser based engine shown in U.S. Pat. No. 4,728,965. Such systems are generally polygon flying spot systems which use red, green, and blue lasers. Unfortunately, as with CRT printers, the laser based systems tend to be expensive, since the cost of blue and green lasers remains quite high. Additionally, the currently available lasers are not compact. Another problem with laser based printing systems is that the photographic paper used for traditional photography is not suitable for a color laser printer due to reciprocity failure. High intensity reciprocity failure is a phenomena by which photographic paper is less sensitive when exposed to high light intensity for a short period. For example, flying spot laser printers expose each of the pixels for a fraction of a microsecond, whereas optical printing systems expose the paper for the duration of the whole frame time, which can be on the order of seconds. Thus, a special paper is required for laser printers.

A more contemporary approach uses a single spatial light modulator such as a Texas Instruments digital micromirror device (DMD) as shown in U.S. Pat. No. 5,061,049. Spatial light modulators provide significant advantages in cost as well as allowing longer exposure times, and have been proposed for a variety of different printing systems from line printing systems such as the printer depicted in U.S. Pat. No. 5,521,748, to area printing systems such as the system described in U.S. Pat. No. 5,652,661.

One approach to printing using the Texas Instruments DMD, shown in U.S. Pat. No. 5,461,411, offers advantages such as longer exposure times using light emitting diodes (LED) as a source. See U.S. Pat. No. 5,504,514. However, this technology is not widely available. As a result, DMDs are expensive and not easily scaleable to higher resolution. Also, the currently available resolution is not sufficient for all printing needs.

Another low cost solution uses LCD modulators. Several photographic printers using commonly available LCD technology are described in U.S. Pat. Nos. 5,652,661, 5,701,185, and 5,745,156. Most of these designs involve the use of a transmissive LCD modulator such as is depicted in U.S. Pat. Nos. 5,652,661 and 5,701,185. While such methods offer several advantages in ease of optical design for printing, there are several drawbacks to the use of conventional transmissive LCD technology. Transmissive LCD modulators generally have reduced aperture ratios and the use of transmissive field-effect-transistors (TFT) on glass technology does not promote the pixel to pixel uniformity desired in many printing applications. Furthermore, in order to provide large numbers of pixels, many high resolution transmissive LCDs possess footprints of several inches. Such a large footprint can be unwieldy when combined with a print lens. As a result, most LCD printers using transmissive technology are constrained to either low resolution or small print sizes.

An alternate approach is to utilize reflective LCD modulators as is widely accepted in the display market. Most of the activity in reflective LCD modulators has been related to projection display. The projectors are optimized to provide maximum luminous flux to the screen with secondary emphasis placed on contrast and resolution. To achieve the goals of projection display, most optical designs use high intensity lamp light sources. Additionally, many projector designs use three reflective LCD modulators, one for each of the primary colors, such as the design shown in U.S. Pat. No. 5,743,610. Using three reflective LCD modulators is both expensive and cumbersome.

The recent advent of high resolution reflective LCDs with high contrast, greater than 100:1, presents possibilities for printing that were previously unavailable. See U.S. Pat. Nos. 5,325,137 and 5,805,274. Specifically, a printer may be based on a reflective LCD modulator illuminated sequentially by red, green, and blue light emitting diodes as is shown in U.S. Pat. No. 6,215,547. This technology too is resolution limited. Also, because the response time of the device is in milliseconds, scanning is not easily used where speed is required.

While the reflective LCD modulator has enabled low cost digital printing on photosensitive media, the demands of high resolution printing have not been fully addressed. For many applications, such as imaging for medical applications, resolution is critical. Micro-mechanical modulators and electro-optic modulators offer the ability to place many pixels in close proximity. Such devices are easily amenable to high resolution printing. Often linear devices such as the grating light valve U.S. Pat. Nos. 5,311,360 and 5,459,610, can be incorporated into printing systems. The line modulator in conjunction with a drum or scanning device can allow for very fast print times.

Modulator printing systems can incorporate a variety of methods to achieve gray scale. Texas Instruments employs a time delayed integration system that works well with line arrays as shown in U.S. Pat. Nos. 5,721,622, and 5,461,410. While this method can provide adequate gray levels at a reasonable speed, line printing time delayed integration (TDI) methods can result in registration problems and soft images. Alternate methods have been proposed particularly around transmissive LCDs such as the design presented in U.S. Pat. No. 5,754,305.

It is desirable to increase the resolution of a photographic image, using available technology, reduce reciprocity failure, while preserving adequate gray scale and keeping cost low. Line modulators such as the grating light valve, often have extremely fast response times. The result is fully achievable gray scale either through differential voltage application or through pulse width modulation. In general, line modulators that operate in schlieren mode offer advantage in resolution and speed in photographic printing systems.

SUMMARY OF THE INVENTION

It is an object of the present invention to provide a high pixel density color image at the media plane in an AgX printing system. It is also an object of this invention to provide means by which to utilize a linear high site density spatial light modulator to create digital images for imaging onto photographic media.

Briefly, according to one aspect of the present invention a printer for printing on a light sensitive media comprises a light source which produces a light beam. Illumination optics comprises cross array components and array direction components for reducing divergence of the beam from the light. The illumination optics flood illuminates a grating modulator with reduced light beams. An address means connects to the grating modulator array for individually addressing modulator sites on the grating modulator array for imparting a phase change to the reduced light beams. An imaging lens directs light from the grating modulator array onto the light sensitive media. The imaging lens comprises a first lens element which converts the light into diffracted and undiffracted light; a spatial filter which discriminates between the diffracted and the undiffracted light; and a second lens element which reconstructs an image of the modulator sites.

In another embodiment the laser sources are imaged color sequentially through uniformizing, and anamorphic optics to create essentially line illumination at a plane of a spatial light modulator. The spatial light modulator is comprised of a plurality of modulator sites in a line. Individual modulator sites diffract, and reflect the incoming light into multiple spatial orders. Light is then imaged through a print lens assembly and a spatial filter onto a media plane. The spatial filter serves to isolate one or more diffracted orders onto the media plane. When the modulator is activated in one state, light is passed through the optical system and is imaged onto the media plane. In the opposite state, light is blocked by the spatial filter and is not imaged onto the image plane. The media is exposed in a color sequential manner with linear color image. The media is placed on a rotating drum such that the drum speed is set in accordance with the illumination requirements of the chosen media.

In yet another embodiment of the invention laser sources are sequentially rotated into position through the use of a rotating wheel or are scanned through the use of a galvo onto the surface of the modulator.

In a further embodiment linear arrangements of light emitting diodes are sequentially scanned onto the spatial light modulator.

In another embodiment a broadband light source followed by color filters sequentially illuminates the linear spatial light modulator.

In yet another embodiment three lines of illumination are spatially separated and used with three distinct spatial light modulators.

In an alternate embodiment three distinct spatial filters are employed.

The invention and its objects and advantages will become more apparent in the detailed description of the preferred embodiment presented below.

DETAILED DESCRIPTION OF THE INVENTION

A diffraction grating spatial light modulator such as a grating light valve is used in a mono-color or multi color format printer. The spatial light modulator is a linear device wherein each modulator site is comprised of a multi-element diffraction grating. In one state, incident light is reflected off the modulator in a manner similar to a planar mirror. In an activated state, a given modulator site is a reflective diffraction grating, which diffracts light into multiple spatial orders.

Figure 1:
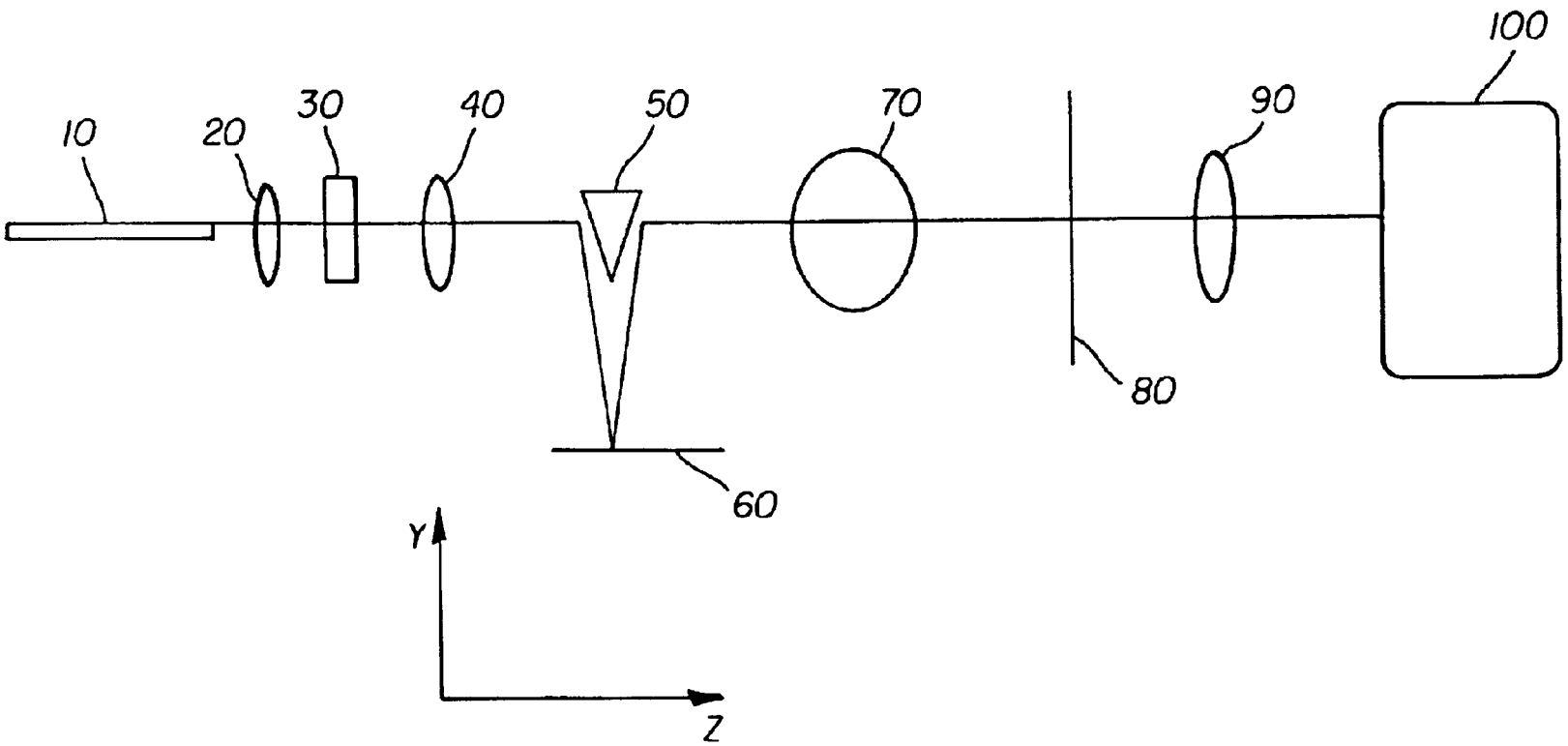
FIG. 1 is a schematic diagram, from the side, showing the optics of the present invention.

Referring to FIG. 1, light is generated by a light source 10 which may be either a laser or a linear array of light emitting diodes. Incident light is collimated along the scan direction and focused along the cross scan direction by means of collimating lens 20 and a cylindrical lens 40 element. In effect the divergence of the incident light beam is reduced. If the source utilized consists of multiple elements, uniformizing optics 30 may be included in one embodiment to provide more uniform illumination of the spatial light modulator 60.

Light is directed onto the spatial light modulator 60 by means of a prism 50. The spatial light modulator imparts a phase difference on a site by site basis to the impingent light. The phase difference is determined by the pitch of the applied grating and the wavelength of the incident light. In the farfield or Fourier plane of the modulator, the light is separated into diffracted orders. Following the spatial light modulator is an imaging lens 70 and a spatial filter 80. The spatial filter is designed to pass only designated orders of light. When a modulator site is in the "on" state, implying that it has been electrically addressed, light is diffracted through the spatial filter 80 and will be imaged onto the media. The modulator modulates light on a site by site basis by means of the address signal. The spatial filter can be a slit, a stop, a series of slits and stop, holographic, or even an active addressable element. Following the spatial filter 80 is lens element 90 designed to provide images of the designated magnifications at the light sensitive media 100. The media is attached to a drum 110 that rotates at a speed determined by the required exposure of the light on the media.

Figure 2:
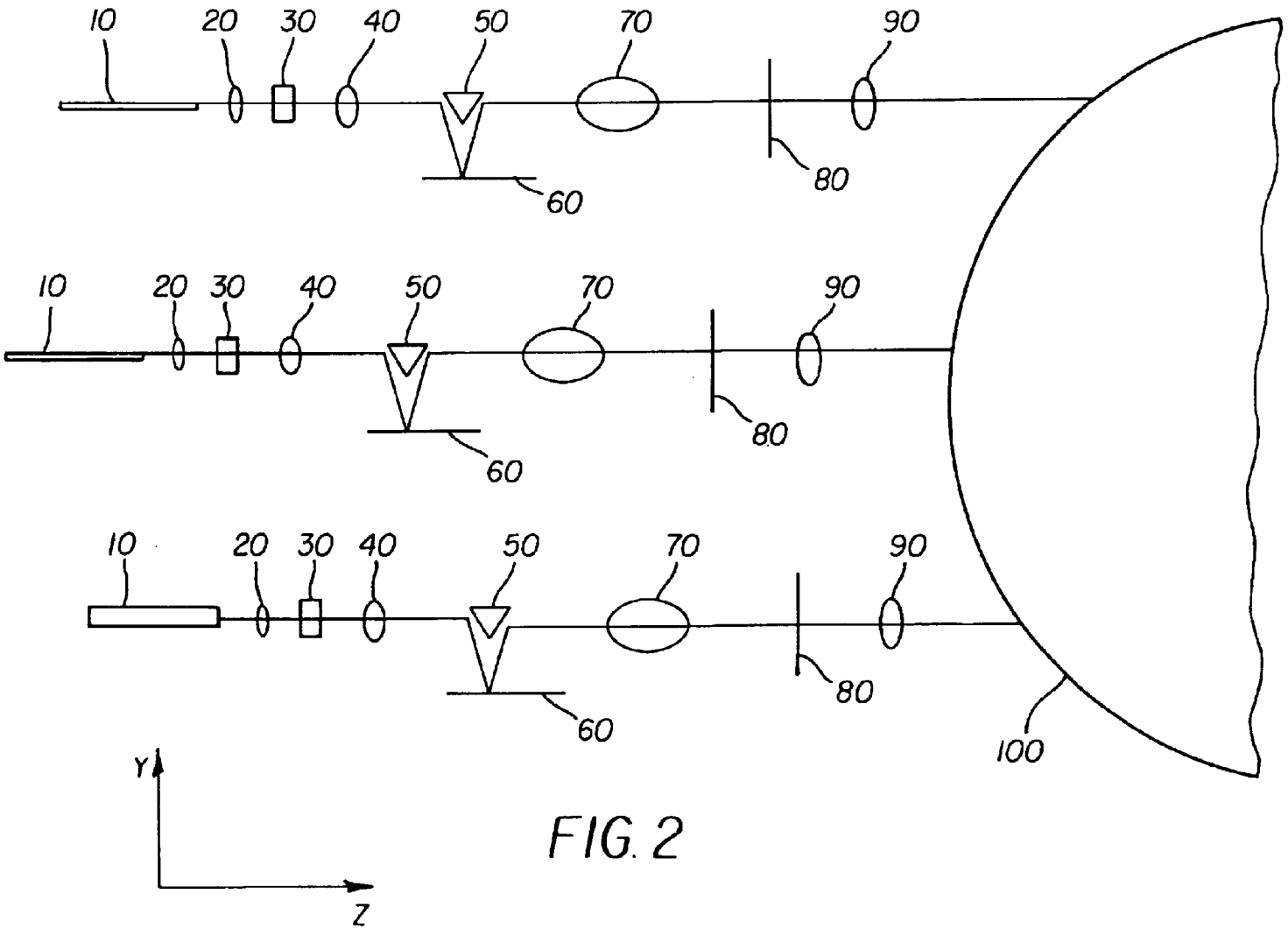
FIG. 2 is a schematic view of a tri-color system using individual projector lenses and prisms.

FIG. 2 shows a three color system designed to provide three lines of illumination at distinct wavelengths at the media plane simultaneously. The system consists of three separate lines of illumination writing three displaced lines at the image plane. As the drum rotates, the media rotates into position. In color. sequence, each line image writes the same line on the media, thus creating a full color image. The strength of the light, the exposure time, and the speed at which the drum rotates determines the density of the image. The gray scale can be established one of two ways. The modulator is either operated in an analog manner, where the grating on a modulator site is addressed at a prescribed voltage corresponding to a preset depth in the grating. The voltage effectively corresponds to how efficiently the site deflects light into a prescribed order. Alternatively each site can be addressed in a pulse width modulation sequence.

Additional bit depth can be achieved by varying the illumination levels as well as addressing the modulator. It is important to note, that because printing is not a real time application, image data need not cycle at a video frame rate. If a procedure takes longer, it does not effect image quality. It is possible to build the system of FIG. 2 by employing a broadband light source with a color filter wheel.

Figure 3:
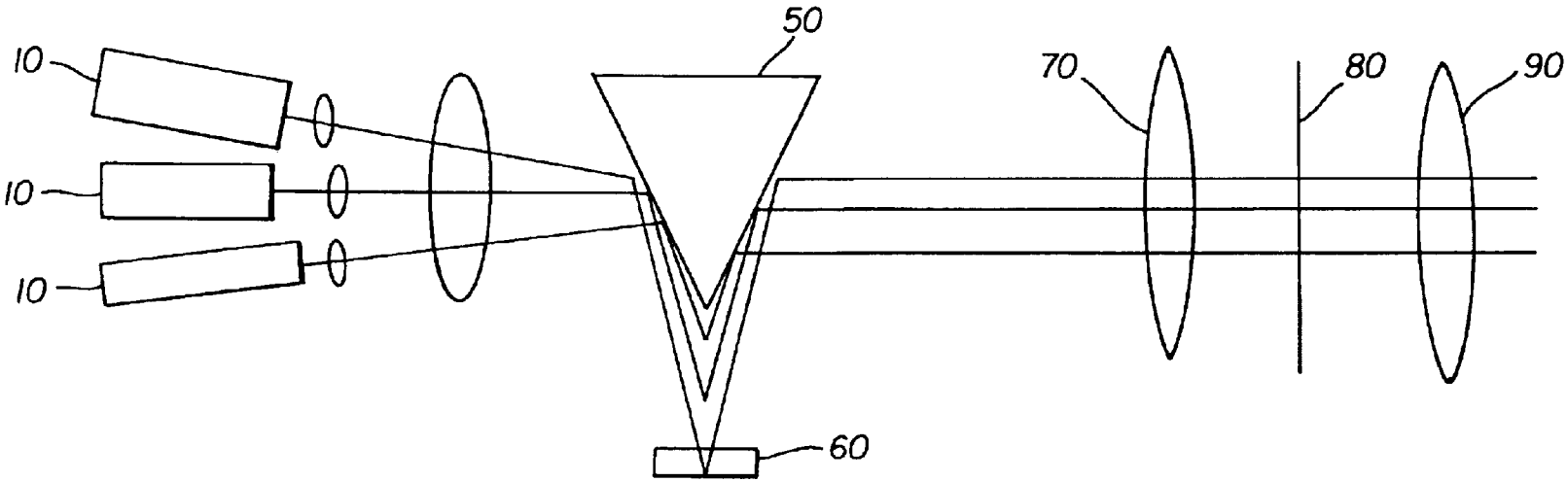
FIG. 3 is a schematic view of a tri-color system using a single projection lens and prism.

FIG. 3 demonstrates a tri-color system using a single projection lens and prism 50. In FIG. 3, the spatial light modulator 60 must contain three distinct lines, one for each color. Each line may be optimized for the specific color of illumination. Such a modulator system is shown in FIG. 3. This system shows three color line of illumination. If a white light source is used, color filtering can effectively be achieved downstream. The modulators may incorporate color filters. If the diffraction angle is quite distinct in each color, it is possible that by simply using three very distinct spatial filters, sufficient discrimination is achieved.

Figure 4:
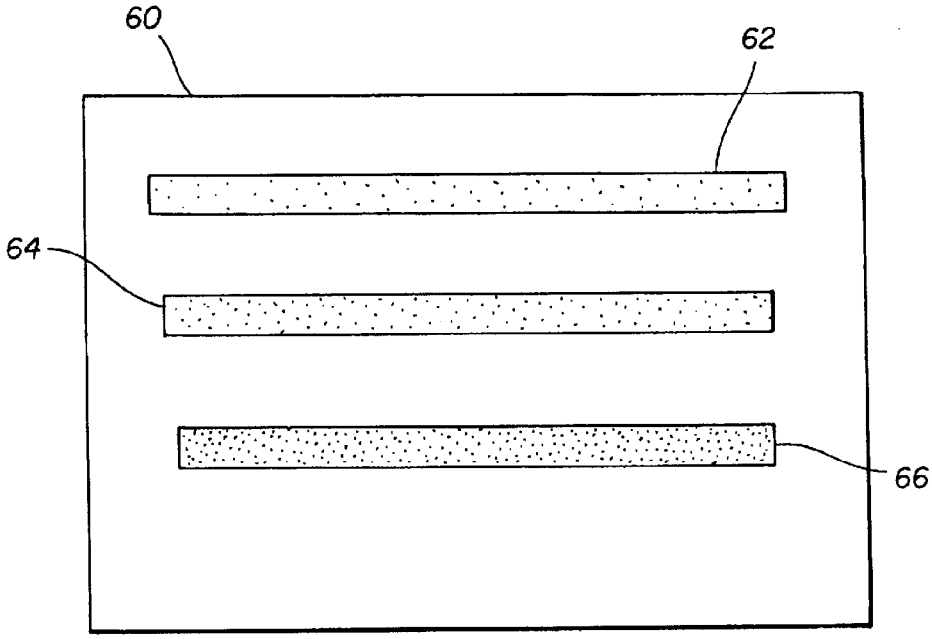
FIG. 4 is a plan view showing three color lines on a single substrate.

In FIG. 4 the red 62, green 64, and blue 66 line are integrated on a single piece of spatial light modulator 60. It should be noted, if the packaging that incorporates the parts can be made sufficiently small, three discrete devices may be placed in proximity of each other.

Figure 5A:
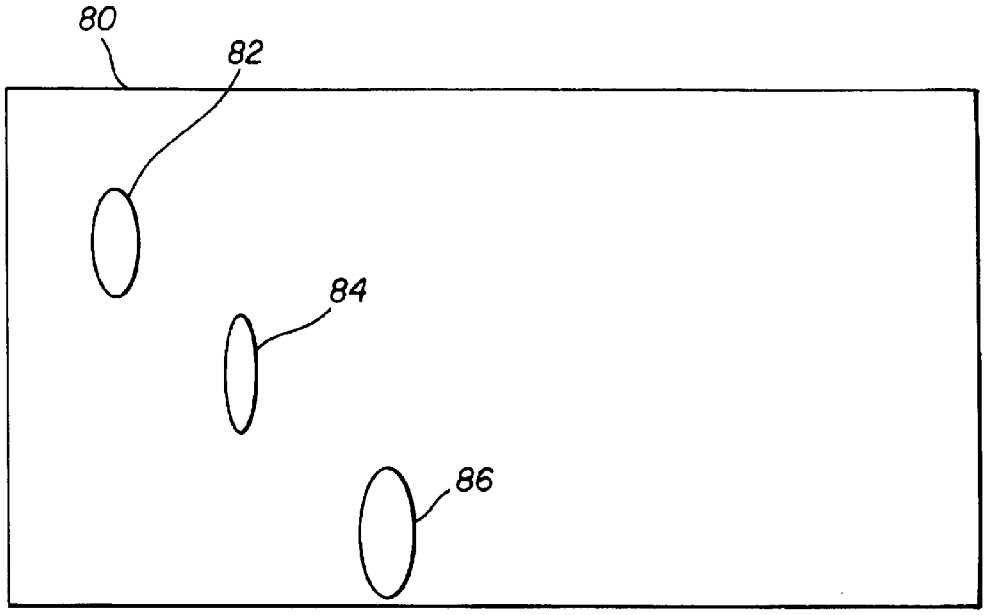
FIG. 5*a* shows a composite filter according to the present invention.
Figure 5B:
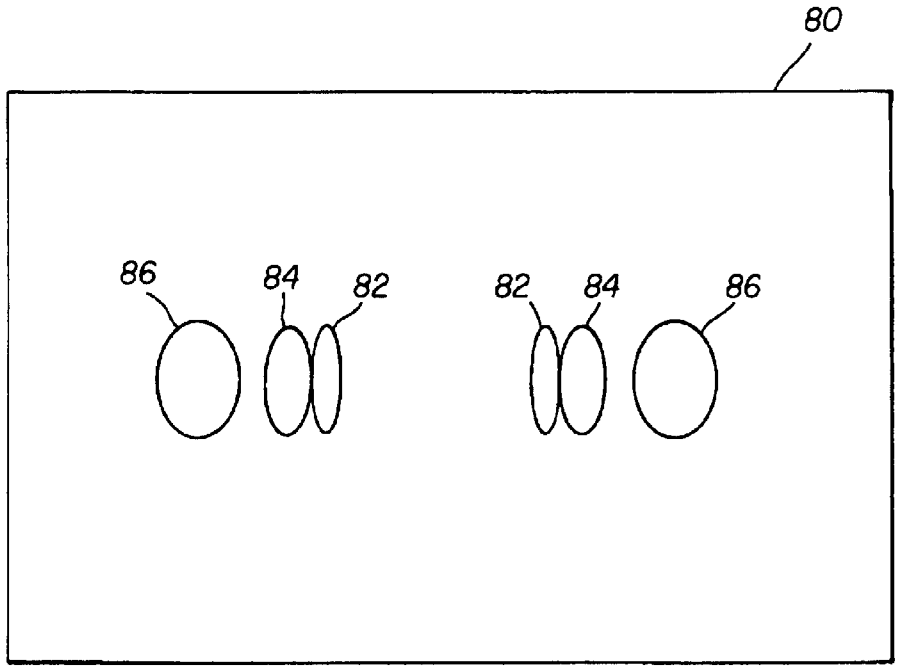
FIG. 5*b* shows a composite filter according to the present invention.

If three distinct lines are employed, the spatial filter requires three separate filters, one for each color 84, 82, and 86, shown in FIG. 5. Because the diffraction angle is wavelength dependent, the filters may differ. A spatial filter 80 is shown in FIG. 5*a*. If the diffraction angles are quite distinct, the single spatial filter can have elements to address each wavelength as is shown in FIG. 5*b*.

Figure 6:
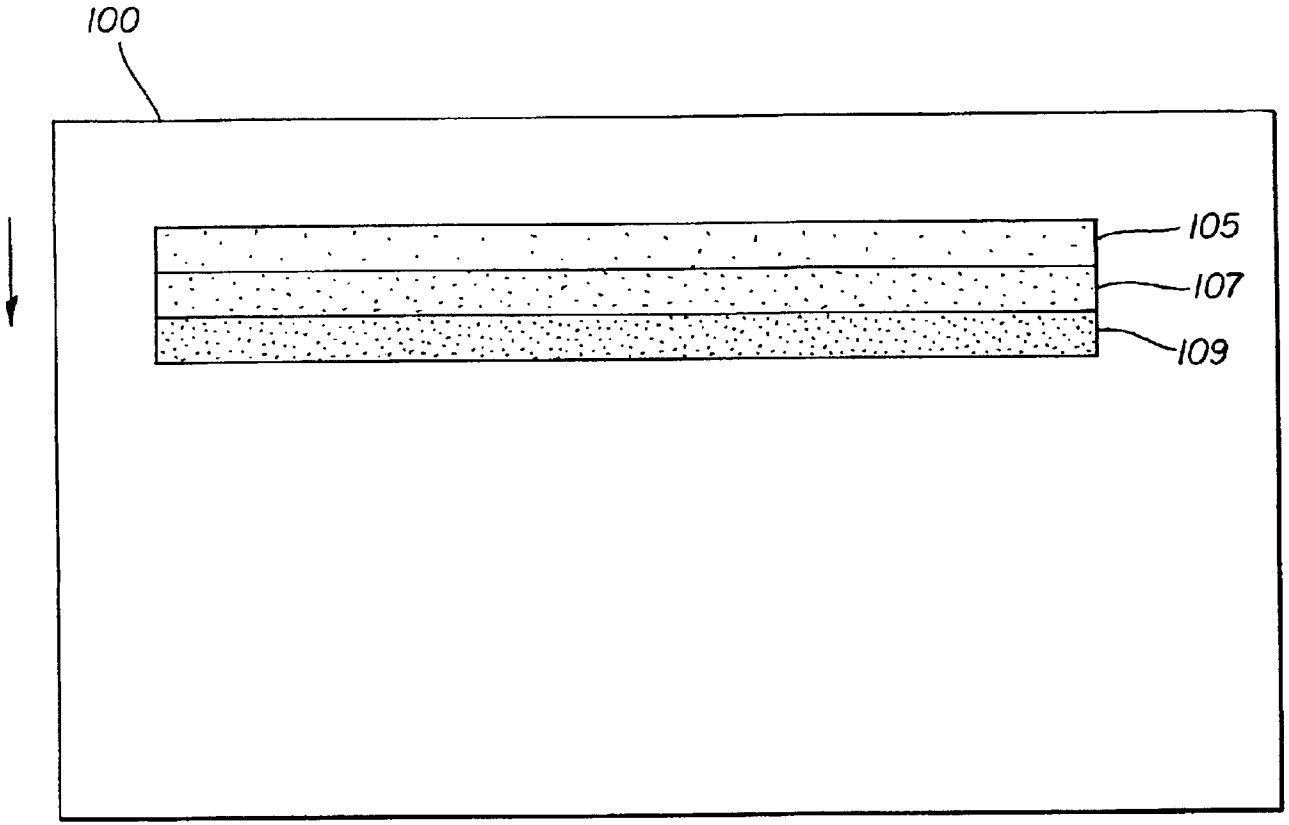
FIG. 6 shows red, green, and blue lines superimposed.
Figure 7:
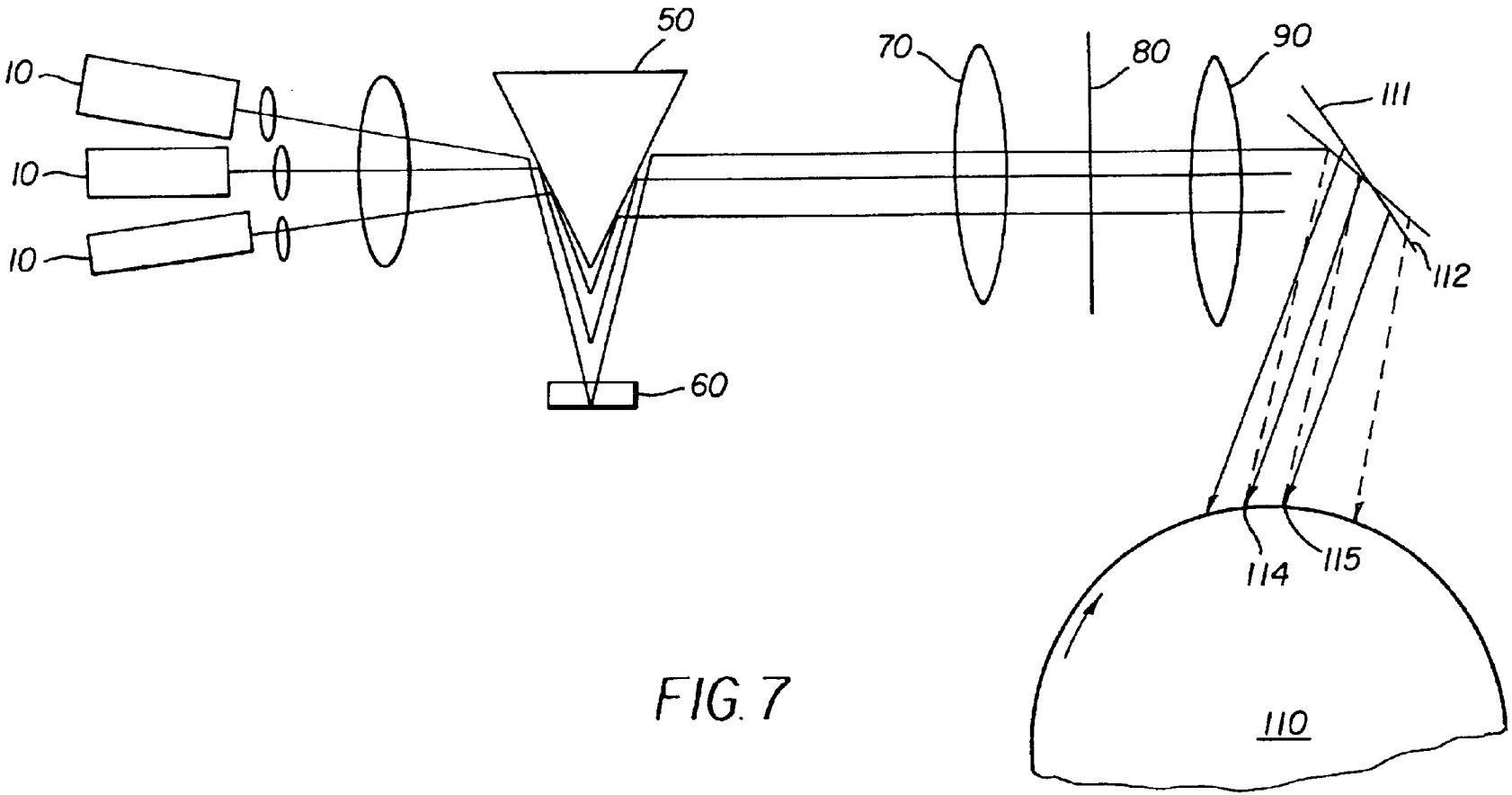
FIG. 7 is a schematic view of a tri-color system using a scanning mirror.

If three lines of illumination are imaged onto the media plane, the composite image is built as a superposition of the three lines. First a line of red illumination is imaged 105, the second is a superposition of green 107 on the red image, and finally a blue line 109 is imaged onto the existing red and green images. This method is shown in FIG. 6. For this method to work, one of three elements must move. The entire print assembly is moving to allow superposition, the image is moving, or the image plane is moving. In the first case the entire printhead assembly is mounted on a moving assembly. Alternatively, for an arrangement as in FIG. 3 where there is only one prism assembly, the prism may tilt and the image printed color sequentially to the same position at the media plane. Another method involves a scanning mirror 111 or transmissive element following the print lens assembly may color sequentially displace the image to the image plane. This is shown in FIG. 7. The scanning mirror moves from a first position 111 to a second position 112. A given written line, such as the red line, moves from a first line 114, to second line 115. This is a method of color sequential printing that requires quick exposure times if the media is moving as in on a drum 110.

Figure 8:
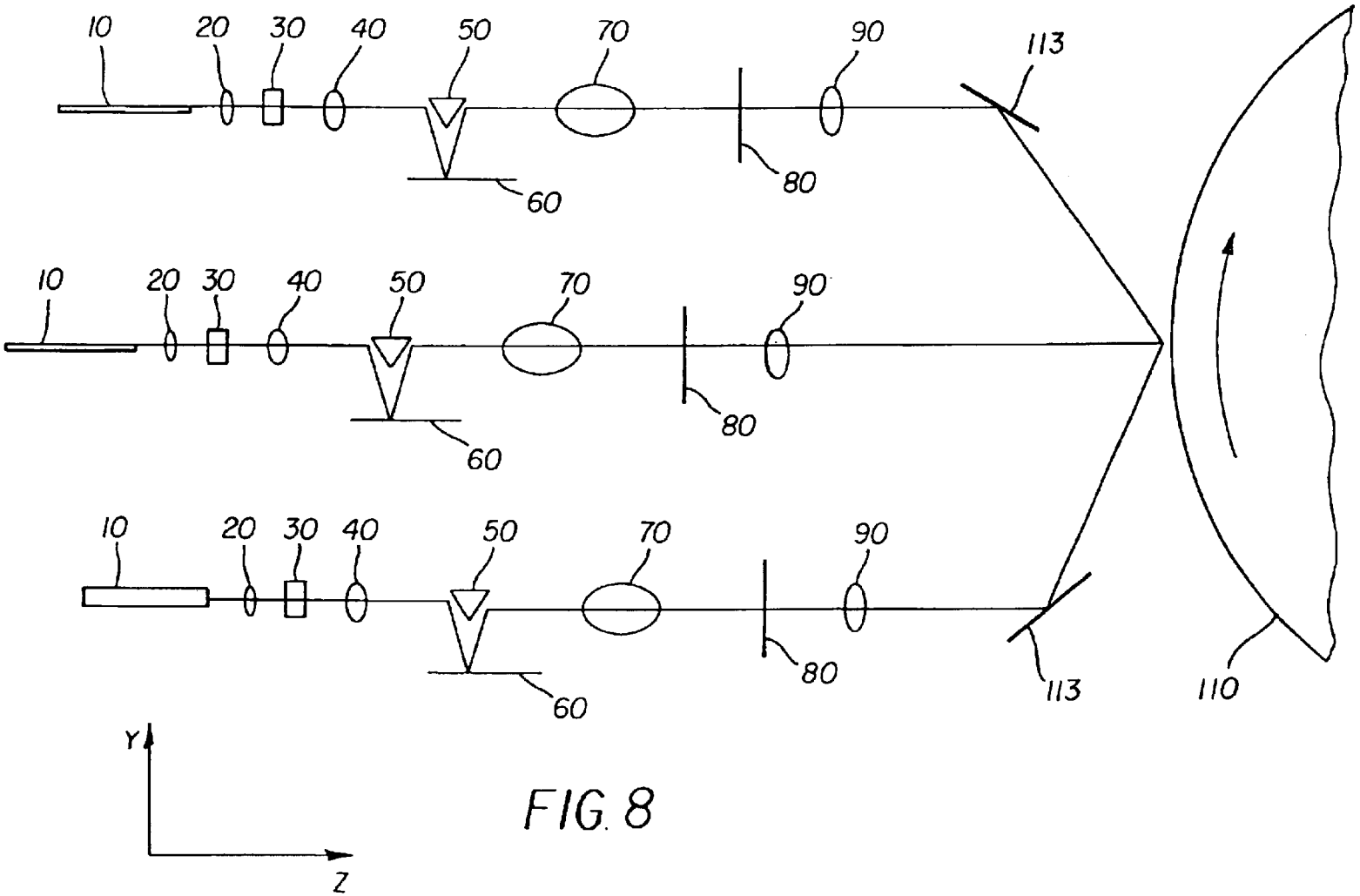
FIG. 8 is a schematic view of a tri-color system with a single composite image line.

In the case of a multiple modulators as in FIG. 2, the image from each illumination line may be directly superimposed by arranging the imaging path with a mirror 113 or redirectional optical element to create an image at the same line in each color as is shown in FIG. 8. This is a form of color recombination printing. This mirror approach can be employed whether there is a single illumination line or multiple illumination lines Alternatively, if drum printing is employed the natural rotation of the drum positions the media in the illumination path as is required for each color. This method allows all three colors to operate simultaneously by writing different lines of data. This is shown in FIG. 2.

It should be noted, if the user is willing to either use a sufficiently large projection lens or work with an off-axis imaging system, the prism may be omitted from the design.

The invention has been described in detail with particular reference to certain preferred embodiments thereof, but it will be understood that variations and modifications can be effected within the scope of the invention.

Parts List

10 Light source
20 Collimating lens
30 Uniformizing optics
40 Cylindrical lens
50 Prism
60 Spatial light modulator
62 Red line
64 Green line
66 Blue line
70 Imaging lens
80 Spatial filter
82 Filter
84 Filter
86 Filter
90 Lens element
100 Light sensitive media
105 Red illumination imaged
107 Green line superpositioned
109 Blue line imaged
110 Drum
111 Scanning mirror in position 1
112 Scanning mirror in position 2
113 Mirror
114 Red line in position 1
115 Red line in position 2

What is claimed is:

1. A printer for printing on a light sensitive medium comprising:

a plurality of light sources which produce a plurality of light beams;

illumination optics comprising cross array components and array direction components for reducing divergence of said beams from said light;

wherein said illumination optics flood illuminates at least one grating modulator array with reduced light beams;

an address means connected to said grating modulator array for individually addressing modulator sites on said prating modulator array for imparting a phase change to said reduced light beams;

an imaging lens which directs light from said grating modulator array onto said light sensitive media comprised of:

a first lens element which converts said light into diffracted and undiffracted light;

a spatial filter which discriminates between said diffracted and said undiffracted light;

a second lens element which reconstructs an image of said modulator sites; and wherein said spatial filter is comprised of a two arrangement of slits wherein said slits are displaced along a first direction to filter specific wavelengths and are displaced along a second direction to filter specific diffractive orders.

2. A printer as in claim 1 wherein said modulator array is a single integrated unit.

3. A printer as in claim 1 wherein said modulator array is comprised of multiple sub-arrays.

4. A printer as in claim 1 wherein said spatial filter is comprised of a plurality of spatial filters.

5. A printer as in claim 4 wherein said plurality of spatial filters is related to wavelength.

6. A printer as in claim 1 wherein said spatial filter is comprised of a holographic diffuser.

7. A printer as in claim 1 wherein said plurality of light sources are a single integrated unit.

8. A printer as in claim 1 wherein the medium is mounted on a drum.

9. A printer as in claim 8 wherein said plurality of light beams overwrite each other on said media.

10. A printer as in claim 9 wherein said beams overwrite each other by motion of said drum.

11. A printer as in claim 9 wherein optical elements redirect said beams to overwrite each other.

12. A printer as in claim 1 wherein said grating modulator array is comprised of two or more distinct lines of modulator sites.

13. A printer as in claim 1 wherein a color filter array and said grating modulator array comprise a single unit.

14. A printer as in claim 1 wherein said plurality of light sources are comprised of LEDs.

15. A printer as in claim 1 wherein said plurality of light sources are comprised of an array of light emitting diodes (LEDs) and lasers.

16. A printer as in claim 15 wherein said LEDs are blue and green LEDs and lasers are red lasers.

17. A printer as in claim 1 wherein said second lens element focuses light along said first direction.

18. A printer as in claim 1 wherein said plurality of light sources are comprised of separate sub-arrays.

19. A printer as in claim 1 wherein said plurality of light sources are comprised of lasers.

20. A printer as in claim 1 wherein a color filter is located in close proximity to said grating modulator and which separates light beam into separate color components.

21. A printer as in claim 1 wherein a color filter is integral with said grating modulator and separates said light beam into separate color components.

22. A printer as in claim 1 wherein said grating modulator array produces gray scale on a site by site basis.

23. A printer as in claim 22 wherein said grating modulator array produces gray scale on site by site basis through pulse width modulation.

24. A printer as in claim 22 wherein said grating modulator array produces gray scale on a site by site basis through analog operation.

25. A printer as in claim 22 wherein said light source is modulated in amplitude and duration.

26. A printer as in claim 1 wherein an optical element rotates to redirect each of said plurality of light beams to overwrite each other on said media.

27. A printer for printing on a light sensitive medium comprising:

a light source which produces a light beam;

illumination optics comprising cross array components and array direction components for reducing divergence of said beam from said light;

wherein said illumination optics flood illuminates at least one orating modulator array with reduced light beam;

an address means connected to said grating modulator array for individually addressing modulator sites on said grating modulator array for imparting a phase change to said reduced light beam;

an imaging lens which directs light from said grating modulator array onto said light sensitive media, comprised of:

a first lens element which converts said light into diffracted and undiffracted light;

a spatial filter which discriminates between said diffracted and said undiffracted light;

a spatial filter which discriminates between said diffracted and said undiffracted light;

a second lens element which reconstructs an image of said modulator sites; and wherein said spatial filter is comprised of a two arrangement of slits wherein said slits are displaced along a first direction to filter specific wavelengths and are displaced along a second direction to filter specific diffractive orders.

28. A printer as in claim 27 wherein said modulator array is a single integrated unit.

29. A printer as in claim 27 wherein said modulator array is comprised of multiple sub-arrays.

30. A printer as in claim 27 wherein said spatial filter is comprised of a plurality of spatial filters.

31. A printer as in claim 30 wherein said plurality of spatial filters is related to wavelength.

32. A printer as in claim 27 wherein said spatial filter is comprised of a holographic diffuser.

33. A printer as in claim 27 wherein said second lens element focuses light along said first direction.

34. A printer as in claim 27 wherein the medium is mounted on a drum.

35. A printer as in claim 27 wherein said grating modulator array is comprised of two or more distinct lines of modulator sites.

36. A printer as in claim 27 wherein a color filter array and said grating modulator array comprise a single unit.

37. A printer as in claim 1 wherein a color filter is located in close proximity to said grating modulator and which separates light beam into separate color components.

38. A printer as in claim 1 wherein a color filter is integral with said grating modulator and separates said light beam into separate color components.

39. A printer as in claim 1 wherein said grating modulator array produces gray scale on a site by site basis.

40. A printer as in claim 39 wherein said grating modulator array produces gray scale on site by site basis through pulse width modulation.

41. A printer as in claim 39 wherein said grating modulator array produces gray scale on a site by site basis through analog operation.

42. A printer as in claim 39 wherein said light source is modulated in amplitude and duration.

* * * * *